United States Patent [19]

Nojima et al.

[11] Patent Number: 5,065,158

[45] Date of Patent: Nov. 12, 1991

[54] INK JET CLEANING MEMBER

[75] Inventors: Takashi Nojima, Tokyo; Tetsuhiro Nitta, Yokohama, both of Japan

[73] Assignee: Canon Kabushiki Kaisha, Tokyo, Japan

[21] Appl. No.: 480,800

[22] Filed: Feb. 16, 1990

[51] Int. Cl.[5] ..... B41J 2/165

[52] U.S. Cl. ..... 346/140 R; 15/250.36; 525/329.3

[58] Field of Search ..... 346/140; 525/329.3, 525/338; 15/250.36

[56] References Cited

U.S. PATENT DOCUMENTS

| | | | |
|---|---|---|---|
| 3,298,030 | 1/1967 | Lewis et al. . | |
| 3,373,437 | 3/1968 | Sweet et al. . | |
| 3,416,153 | 12/1968 | Hertz et al. . | |
| 3,700,637 | 10/1972 | Finch | 525/329.3 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,581,417 | 4/1986 | Buding | 525/329.3 X |
| 4,723,129 | 2/1988 | Endo et al. . | |
| 4,740,796 | 4/1988 | Endo et al. . | |
| 4,853,717 | 8/1989 | Harmon | 346/140 |

FOREIGN PATENT DOCUMENTS

| | | |
|---|---|---|
| 57-61574 | 4/1982 | . |
| 2607313 | 9/1977 | Fed. Rep. of Germany . |
| 57-80064 | 5/1982 | Japan . |
| 52-102728 | 8/1977 | Japan . |
| 57-116655 | 7/1982 | Japan . |
| 59-123670 | 7/1984 | Japan . |
| 59-138461 | 8/1984 | Japan . |
| 59-164149 | 9/1984 | Japan . |
| 61-230949 | 10/1986 | Japan . |
| 61-61985 | 12/1986 | Japan . |

*Primary Examiner*—Joseph W. Hartary

*Attorney, Agent, or Firm*—Fitzpatrick, Cella, Harper & Scinto

[57] ABSTRACT

A cleaning member is positioned to bear against the discharge port forming surface of an ink jet recording head, in which ports for discharging ink therethrough are formed, to thereby clean the discharge portion forming surface is formed of a material composed chiefly of hydrogenated nitrile butadiene rubber.

11 Claims, 7 Drawing Sheets

INK JET CLEANING MEMBER

BACKGROUND OF THE INVENTION

1. Field of the invention

This invention relates to a cleaning member for removing condensation and ink wetness created on the ink discharge port surface of a recording head carried on an ink jet recording apparatus applicable to an apparatus using an ink jet recording apparatus as the output unit of an image display apparatus or an image forming apparatus, such as a coyping apparatus, a facsimile apparatus, an electronic desk top calculator, a typewriter, a printer as the output unit of a computer or the like, or a composite apparatus, and an ink jet recording apparatus provided with the cleaning member.

2. Related Background Art

As the main current of the ink jet recording system, mentioned may be made of the system using a piezoelectric element and the bubble jet system which is compact and can accomplish formation of liquid droplets well represented by Japanese Patent Publication No. 61-61985. These systems form a liquid droplet in comformity with a desired electrical signal, and causes the discharged liquid droplet to adhere to a recording medium spaced apart from the discharge port of an ink jet head to thereby accomplish printing or image formation.

In a recording apparatus to which this ink jet recording system is applied, it has sometimes happened that water content contained in ink and a recording medium is evaporated to make the atmosphere of the recording head highly humid and cause condensation to occur on a surface in which the ink discharge port of the recording head is formed, depending on conditions such as the temperature of the recording head and of its atmosphere.

It has also sometimes happened that droplets resulting from the rebound occurring when the discharged ink impacts a recording medium, or minute ink droplets other than the liquid droplets discharged from the discharge ports and the satellites thereof adhere to the discharge port surface (i.e., the surface of the head). When condensation thus occurs on the discharge port surface or minute ink, droplets adhere to the discharge port surface, it has sometimes happened that the original function of the apparatus is degraded and discharge from some discharge ports becomes difficult or the direction of discharge is changed. That is, when condensation or wetness occurs on the discharge port surface, waterdrops or the like adhere to the discharge port surface, and these adhering waterdrops or the like pull discharged ink non-uniformly when ink is discharged from the discharge ports. Thereby, irregularity of the direction of discharge and the speed of discharge of the ink and the diameter of ink droplets results, thus deteriorating the quality of recording. Also, the wetness of the discharge port surface makes paper powder, dust and the like likely to adhere to the discharge port surface. Therefore, these conditions adversely affect the direction of discharge of the ink or cause the discharge ports to be clogged, and this has sometimes become a cause of the deteriorated quality of recording. The phenomenon such as the above-described condensation or wetness has become more remarkable where a fixation heater is used to expedite the fixation of recorded images on a recording medium or where the dot duty of recorded images is high.

In order to solve this phenomenon, it has been conceived and proposed to clean the discharge port surface and remove condensation, wetness and the like.

Firstly, wiping the discharge port surface by the use of a solid rubber blade or a metallic blade is mentioned, and secondly, wiping the discharge port surface by an absorbing member is mentioned.

The wiping by an absorbing member is not known in detail as in Japanese Laid-Open Patent Application No. 57-61574 (detailed description thereof is not made therein), and the use of a porous substance and the use of Japanese paper or cloth as in Japanese Laid-Open Patent Application No. 57-80064 and Japanese Laid-Open Patent Application No. 57-116655 have been proposed, but have not yet be put into practice.

On the other hand, a construction in which, unlike the usual cleaning for the purpose of washing the discharge port surface, a sponge impregnated with ink-soluble liquid is caused to bear against the discharge port surface and apply the liquid to the discharge port surface is disclosed in Japanese Laid-Open Patent Application No. 59-164149.

On the other hand, as a method of wiping the discharge port surface by a rubber blade, mention may be made of Japanese Laid-Open Patent Application No. 52-102728 (German Patent Publication DE-OS-2607313.2) and Japanese Laid-Open Patent Application No. 61-230949.

In numerous patent citations showing rubber solid blades, including these, only the construction thereof is shown. Of course, the effect of cleaning the discharge port surface by the use of these blades is recognized.

For example, if cleaning is not performed, as shown in FIG. 1 of the accompanying drawings, a so-called "leak condition" 3 of ink such as minute ink droplets and ink droplets made gigantic by the aggregation thereof is created on a head surface (discharge port surface) 2 which is a surface in which discharge ports are formed. In the on-demand type ink jet system particularly like the BJ (bubble jet) system, this occurs when the duty or rate of discharge becomes high. Also, in the continuous injection type ink jet system described in U.S. Pat. Nos. 3,373,437, 3,298,038 and 3,416,153, recording liquid is continuously discharged from discharge ports and therefore, "leak" occurs more readily.

FIG. 2 of the accompanying drawings shows the result of wiping the condition of "leak" indicated by 3 in FIG. 1 substantially perpendicularly to the direction of arrangement of discharge ports 8 by the use, for example, of an elastic blade chiefly of silicone rubber or urethane rubber having a conventional construction (this is a conventional cleaning method).

For example, where use is made of a blade of silicone rubber having a hardness of the order of 40° and a thickness of the order of 0.2–0.6 mm to a relatively small thickness of 0.2–0.4 mm determined so as not to damage, for example, the coating or the like of the discharge port surface by the elastic force of the blade, it has sometimes been the case that the pressure contact force of the blade to the discharge port surface is not sufficient and therefore water content, dust, etc. adhering to the discharge port surface of the recording head cannot be completely removed.

In contrast, if the thickness of the silicone rubber is made relatively great, e.g. 0.4–0.6 mm, the pressure contact force becomes sufficient and water content dust, etc. adhering to the discharge port surface of the recording head can be removed well, but if the wiping operation is performed 300,000 times or so, it has sometimes been the case that the silicone material abraded thereby adheres to the discharge port surface and discharge ports of the recording head and the unsatisfactory discharge as described above occurs.

In addition, with regard particularly to the state of pressure contact between the blade and the discharged port surface, in order to forcibly clean the discharge port surface, it has been proposed to use a relatively high pressure of line pressure 25 g/cm or more as the pressure of contact between the discharge port surface and the blade to thereby enhance the cleaning effect. The line pressure herein referred to is the load divided by the length of contact.

As a problem resulting from the high pressure of contact, it has happened that the friction of the blade itself occurs to deteriorate the durability of the blade. Particularly, where the discharge port surface is treated with a water-repelling agent to form a condition in which it is difficult for ink to adhere to the discharge port surface, i.e., a condition in which the discharged port surface can be readily cleaned, it has been found that the water-repelling agent is removed by this high pressure and all the more, unsatisfactory cleaning occurs.

SUMMARY OF THE INVENTION

Accordingly, it is an object of the present invention to provide a cleaning member formed of a material which can achieve a good cleaning effect even by a pressure of contact lower than in the prior art.

It is another object of the present invention to provide a cleaning member which will not spoil the effect of wiping and can minimize the abrasion of a blade.

It is another object of the present invention to provide a cleaning member which has a property of anti-solubility to ink (the ink-resisting property) contacted by the cleaning member each time cleaning is effected, that is, which will not be deteriorated by the ink even if it contacts the ink.

It is another object of the present invention to provide a cleaning member of a material which will stand long-term use and which has such a weather-resisting property that the cleaning member itself is not deteriorated even by the ambient environment.

It is another object of the present invention to provide a cleaning member which has an anti-damaging property to the discharged port forming surface of a recording head, that is, which will not scrape off the water-repelling agent of the discharge port forming surface or will not injure discharge ports themselves.

It is another object of the present invention to provide a cleaning member formed of a material which has a liquid contacting property to ink, that is, which will not adversely affect the ink.

It is another object of the present invention to provide a cleaning member formed of a material which is cold-proof and whose hardness is changed very little even at low temperatures.

It is another object of the present invention to provide an ink jet recording apparatus with an excellent cleaning member which can accomplish effective cleaning with a lower pressure and which satisfies various characteristics such as the anti-solubility (the ink-resisting property), the weather-resisting property, the anti-damaging property, the liquid-contacting property to ink, and the cold-proof property.

Thus, it is an object of the present invention to provide an ink jet recording apparatus which does not suffer from unsatisfactory ink discharge and which suffers very little from the deterioration of the quality of printing and is excellent in recording characteristic.

It is another object of the present invention to provide a cleaning member for bearing against the discharge port forming surface of an ink jet recording head in which ports for discharging ink therethrough are formed to thereby clear said discharge port forming surface, characterized in that said cleaning member is formed of a material composed chiefly of hydrogenated nitrile butadiene rubber.

It is another object of the present invention to provide an ink jet recording apparatus having an ink jet recording head provided with an opening for discharging ink therethrough, carriage means for moving said ink jet recording head between a recording position in which recording is effected with said recording head opposed to a recording medium and a non-recording position in which said ink jet recording head is retracted from said recording position, and a cleaning member provided in a movement path between said recording position and said non-recording position for bearing against the discharge port forming surface of said ink jet recording head in which said discharge ports are formed to thereby clean said discharge port forming surface, said cleaning member being formed of a material composed chiefly of hydrogenated nitrile butadiene rubber.

The discharge port forming surface of a recording head is cleaned by a cleaning member which can accomplish cleaning effectively with a low pressure and which is formed of a material satisfying the anti-solubility (the ink-resisting property), the weather-resisting property, the anti-damaging property, the liquid-contacting property to ink and the cold-proof property, whereby removal of ink, dust and the like adhering to the discharge port forming surface can be accomplished highly effectively.

Also, even if cleaning is repeated, the cleaning member itself and further the discharge port forming surface of the recording head will not be deteriorated and the discharging performance will not be reduced and stable discharge of ink can be effected for a long period of time.

DESCRIPTION OF THE PREFERRED EMBODIMENTS

Some embodiments of the present invention will hereinafter be described in detail with reference to the drawings.

Figure 1:
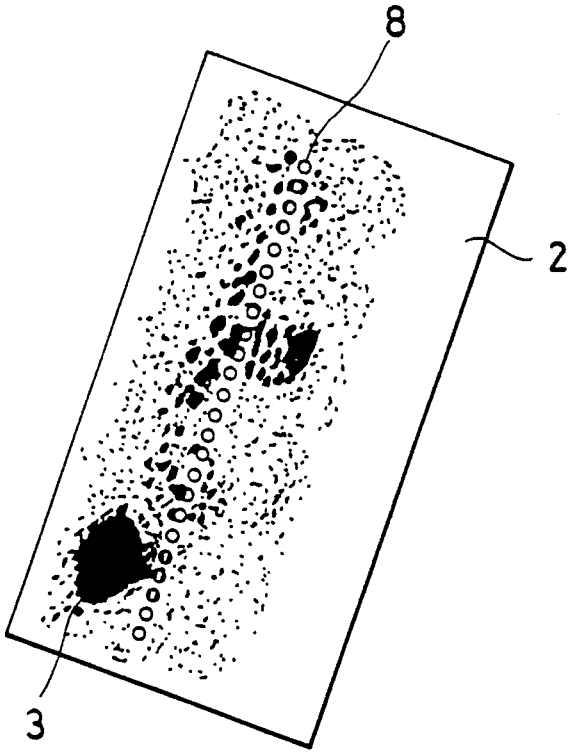
FIG. 1 is a schematic view showing an example of the discharge port forming surface (the head surface) on which wetness is created.
Figure 2:
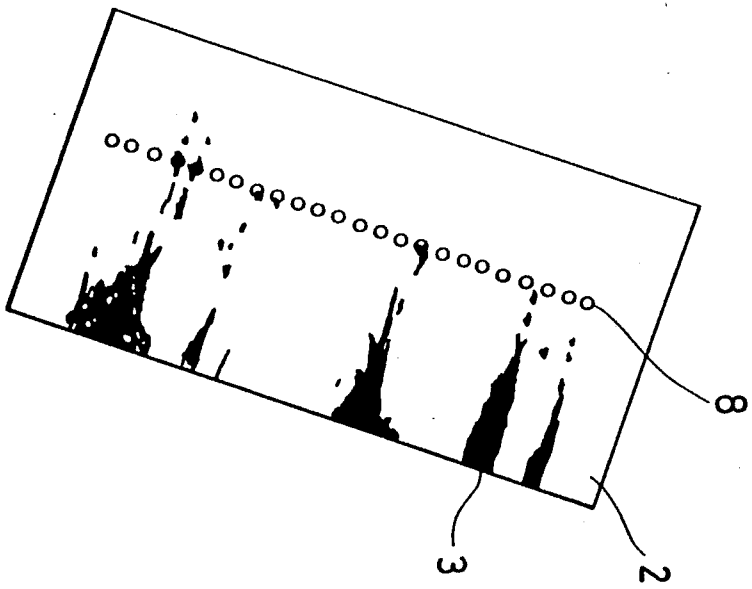
FIG. 2 is a schematic view showing an example of the discharge port forming surface when it is wiped by the use of a rubber blade of conventional construction.
Figure 3:
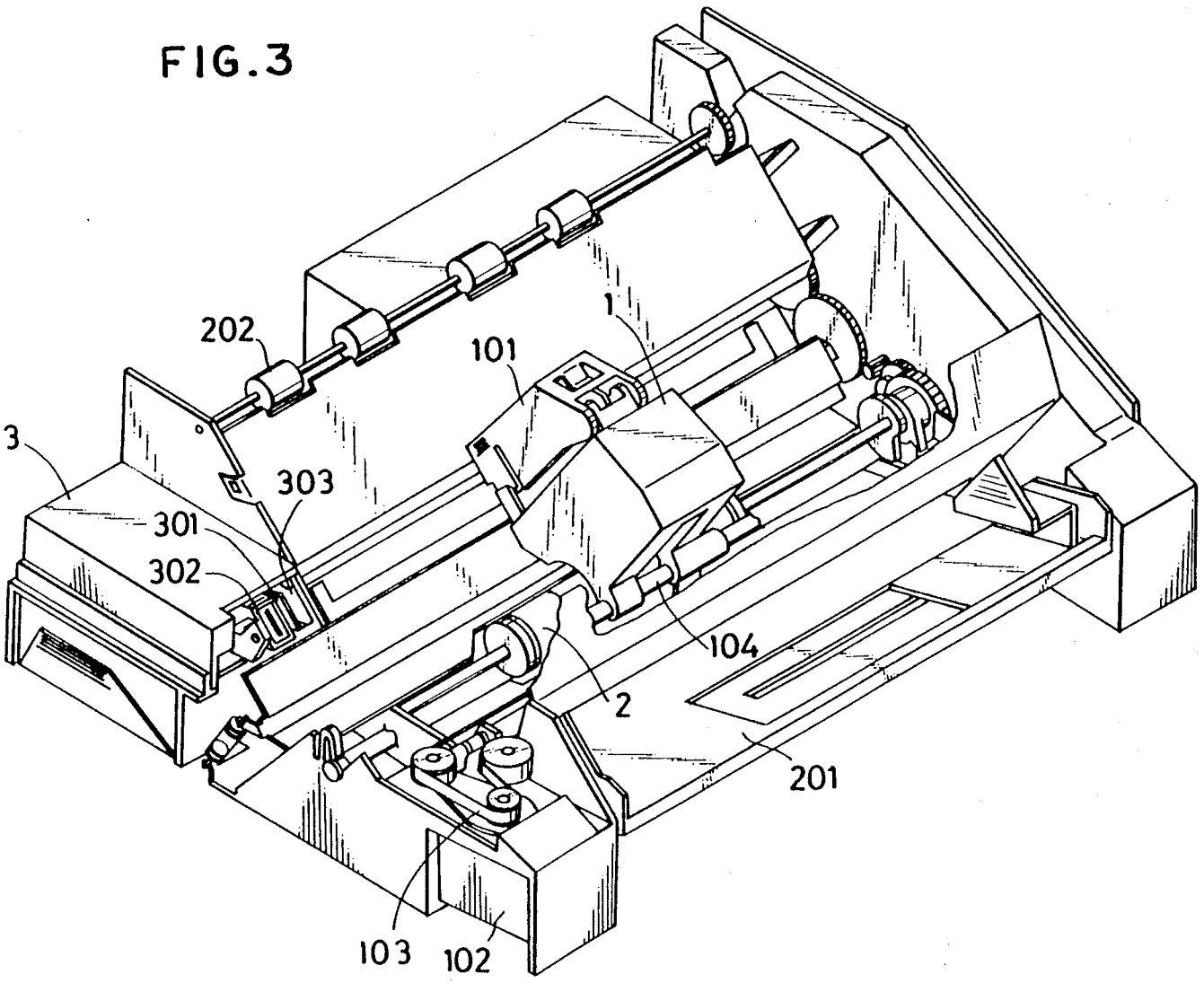
FIG. 3 is a perspective view schematically showing an ink jet recording apparatus according to an embodiment of the present invention.

FIG. 3 is a perspective view of an ink jet recording apparatus in which the wiping member of the present invention is used.

In FIG. 3, the reference numeral 301 designates a blade as a cleaning member for cleaning the discharge port forming surface of a recording head. One end of the blade 301 is held by a blade holding member which will be described later and provides a fixed end in the form of cantilever. The blade 301 is disposed at a location adjacent to the recording area by the recording head, i.e., a so-called non-recording area. Also, in the case of the present embodiment, the blade 301 protrudes into the movement path of the recording head and is held in a form in which it bears against the discharge port forming surface each time the recording head scans between the recording area and the non-recording area. The blade is not restricted to the form as shown in the present embodiment wherein it is fixedly disposed, but may be of a construction which can assume a cleaning position and a non-cleaning position with the forward and backward movement of a cap or by independent moving means. The reference numeral 302 denotes a cap which is disposed at a home position in the non-recording area adjacent to the blade 301 and which is constructed so as to be movable in a direction perpendicular to the direction of movement of the recording head, i.e., a direction for bearing against or being spaced apart from the recording head, and bear against the discharge port forming surface to thereby effect capping. The reference numeral 303 designates an ink absorbing member provided adjacent to the blade 301. The ink absorbing member 303, like the blade 301, is held in a form in which it protrudes into the movement path of the recording head. The blade 301, the cap 302 and the ink absorbing member 303 together constitute a discharge recovering portion 3, and removal of water content, dust and the like on the ink discharge port forming surface is accomplished by the blade 301 and the absorbing member 303.

The absorbing member 303 is not always necessary, but may be eliminated.

The reference numeral 101 designates a recording head which has an electro-thermal converting member as discharge energy generating means and which is disposed in opposed relationship with the discharge port surface in which discharge ports are disposed, and which utilizes heat energy to discharge ink to a recording medium to thereby accomplish recording, and the reference numeral 1 denotes a carriage carrying the recording head 101 thereon for moving the recording head 101. The present embodiment is such that desired recording is accomplished by the relative movement of the scanning of the recording head 101 carried on the carriage and the conveyance of the recording medium by recording medium conveying means which will be described later. The carriage 1 is slidably engaged with a guide shaft 104, and a portion of the carriage 1 is connected (not shown) to a belt 103 driven by a motor 102. Thus, the carriage 1 is movable along the guide shaft 104, and is movable in the recording area for recording by the recording head 101 and the area adjacent thereto.

The reference numeral 201 designates a paper supply portion for inserting a recording medium, and the reference numeral 2 denotes a paper feeding roller driven by a motor, not shown. The recording medium is fed to a position opposed to the discharge port surface of the recording head by the paper feeding roller 2, and the recording medium is conveyed in association with the scanning of the recording head and is discharged into a paper discharge portion in which a paper discharge roller 202 is disposed as recording progresses.

In the above-described construction, when the recording head 101 is returned to the home position at the end of recording, the cap 302 of the discharge recovering portion 3 is retracted from the movement path of the recording head 101, but the blade 301 protrudes into the movement path. As a result, the discharge port surface is wiped without fail when the recording head 101 is returned to the cap 302 portion disposed in the non-recording area. When the cap 302 bears against the discharge port surface of the recording head 101 to effect capping, the cap 302 is suitably moved so as to protrude into the movement path of the recording head.

Figure 4:
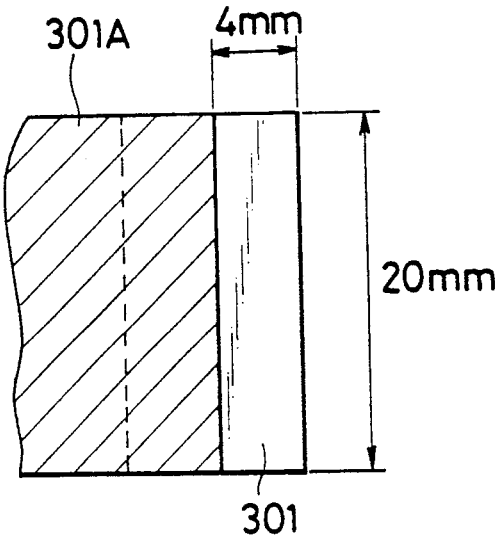
FIGS. 4(A), 4(B), 4(C) and 4(D) are a schematic side view and a top plan view showing a cleaning member according to an embodiment of the present invention, and schematic views showing the overlap relation between the blade and a recording head, respectively.
Figure 4:
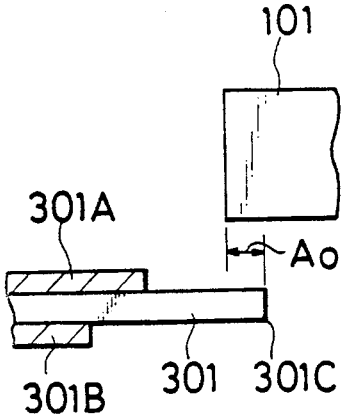
Figure 4:
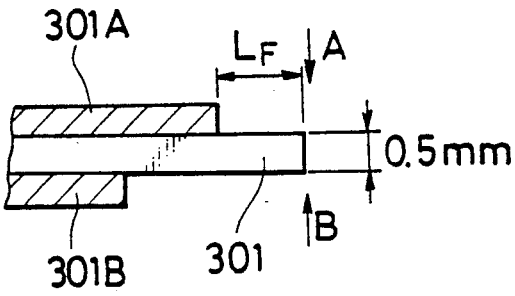
Figure 4:
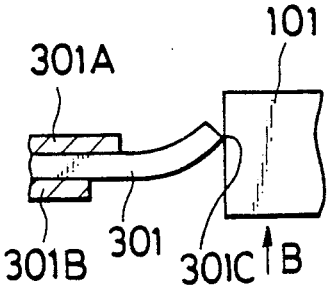

When the recording head 101 is moved from the home position to the recording start position, the cap 302 and the blade 301 are at the same position as the position during the above-described wiping. As a result, again in this movement, the discharge port surface of the recording head 101 is wiped. That is, as shown in FIG. 4(D), wiping is effected when the recording head is moved, for example, from the non-recording area to the recording area (in the direction of arrow B in FIG. 4(D)). At this time, the state in which the blade 301 bears against the recording head 101 is a so-called forward direction bearing state in which the blade 301 is curvedly deformed in the same direction as the direction of movement of the recording head 101.

Accordingly, the area of the blade 301 which includes an edge portion 301C corresponding to the end portion on the extension of that side of the blade 301 which begins to bear against the recording head, i.e., the side adjacent to arrow B in FIG. 4(D), bears against the discharge port forming surface of the recording head 101 to thereby effect cleaning. In the cleaning of the discharge port forming surface by the blade 301, it is important that the area including the edge portion 301C of the blade 301 bears against the discharge port forming surface to thereby effect cleaning, and by bringing the line pressure applied to the edge portion into an optimum range, ink and dust on the discharge port forming surface can be removed well.

The blade 301 of the present embodiment is sandwiched by and between holding members 301A and 301B as shown in FIG. 4(B) so that the length of the substantial arm of the blade 301 varies in the direction in which it bears against the recording head, and the blade 301 has a free length $L_F$ and the wiping force thereof differs depending on the direction in which the blade bears against the recording head. That is. when the recording head is moved toward the home position in the direction of arrow A indicated in FIG. 4(B), the length of the substantial arm becomes great and the force with which the blade bears against the discharge port forming surface becomes weak, and when the recording head is moved toward the recording start position, the length of the substantial arm becomes small and the force with which the blade bears against the discharge port forming surface of the recording head becomes such a degree of magnitude that can sufficiently remove condensation or the like.

Design may also be made such that the above-described movement of the recording head to the home position takes place not only at the end of recording and during the discharge recovery, but also the recording head is moved to the home position adjacent to the recording area at a predetermined interval (timing) during the movement of the recording head in the recording area for the purpose of recording and the above-described wiping is effected with this movement.

Also, in the above-described embodiment, the blade 301 is fixed in the form in which it protrudes into the movement path of the recording head, but alternatively, design may be made such that for example, the blade is also movable with the movement of the cap and is retracted from the movement path during the movement of the recording head in one direction and moves forward so as to bear against the discharge port forming surface of the recording head only during the movement of the recording head in the other direction, whereby cleaning is effected.

Now, the blade adapted to bear against the discharge port forming surface of the recording head during the movement of the recording head from the recording area to the non-recording area or from the non-recording area to the recording area must be able to well remove ink, dust, viscosity-increased ink, etc. adhering to the discharge port forming surface.

Also, the blade is designed to directly contact the ink and the discharge port forming surface and therefore must not adversely affect nor be adversely affected by the latter.

Further, the blade need maintain its cleaning characteristic for a long period of time.

For the sake of convenience, these characteristics are represented by the following: anti-solubility to ink (the ink-resisting property), the weather-resisting property, the anti-damaging property to the discharge port forming surface of the recording head, the liquid-contacting property to ink and the cold-proof property, and will hereinafter describe a blade material to which the present invention is applied.

The inventors have found it to be preferable to use hydrogenated nitrile butadiene rubber as a blade material which satisfies these conditions and can achieve a preferable cleaning effect.

Hydrogenated nitrile butadiene rubber is nitrile rubber with hydrogen added thereto which uses Zetpol (trade name) produced by NOK Co., Ltd. as a raw material, and is expressed by a general expression $$[-CH_2-CH_2-CH_2-CH_2-]_n[CH_2-\underset{\underset{C\equiv N}{|}}{CH}-]_m,$$

and is a material very excellent in heat resisting property, chemcial-resisting property, ozone-resisting property, strength characteristic and wear-resisting property. This material has a particular carbon-carbon saturated coupled portion expressed by ($CH_2$—$CH_2$) to thereby display an effect excellent in elasticity, heat-resisting property, chemical stability (ink-resisting property), ozone-resisting property (weather-resisting property), cold-proof property, etc., and has an acrylonitrile portion expressed by $$CH_2-\underset{\underset{C\equiv N}{|}}{CH}$$

to thereby display an effect excellent in oil resistance, fuel oil resistance, high strength (durability), etc. Further, by being vulcanized and hydrogenated, it displays an effect excellent in elasticity, weather-resisting property, etc.

Hydrogenated nitrile butadiene rubber is improved in durability if the amount of acrylonitrile is increased, and is reduced in hardness and further reduced unsaturated coupling if the iodine value in is reduced (the hydrogenation rate becomes higher) and therefore, becomes difficult to be oxidized by oxygen or the like in the air and is improved in long-term stability and weather-resisting property. With these characteristics taken into account, raw materials can be blended to thereby obtain hydrogenated nitrile butadiene rubber which satisfies desired conditions.

The relation between the desired conditions and hydrogenated nitrile butadiene rubber will hereinafter be described.

(A) Hardness suitable for the blade material

It is necessary that the blade material directly bearing against the discharge port forming surface of the recording head can remove ink and dust well and that it have such elasticity that it will not scrape off the water-repelling agent applied to the discharge port forming surface or will not damage the discharge port forming surface itself.

Accordingly, the hardness suitable for the blade material which satisfies these conditions is preferably in the range of greater than 35° to less than 80°, and more preferably greater than 40° to less than 70°, and still more preferably greater than 45° to less than 65°. The hardness becomes lower as the hydrogen addition rate of hydrogenated nitrile butadiene rubber becomes greater, and becomes higher as the amount of acrylonitrile is increased. Accordingly, desired hardness obtained by suitably selecting these amounts.

(B) Anti-solubility (ink-resisting property) of the blade material

The blade removes ink, etc. by directly contacting with the recording head, and the surface of the blade is always exposed to direct contact with ink.

Accordingly, the blade material need be a material having durability to ink components. This is improved by increasing the hydrogen addition rate, and the hydrogen addition rate is suitably selected so that a desired ink-resisting property may be obtained.

(C) Weather-resisting property of the blade material

The blade material is always held exposed to the atmosphere and therefore, it is important for the blade material to have a weather-resisting property so that its performance of use may be maintained for a long period of time.

In hydrogenated nitrile butadiene rubber, the carbon-carbon unsaturated coupling in nitrile butadiene rubber is decreased by increasing the hydrogenation rate, and the rate at which it is coupled to oxygen in the air is decreased and it becomes difficult to be oxidized and therefore, its long-term usability is improved and its excellence in the weather-resisting property is obtained. However, the hydrogenation rate has the effect of improving the weather-resisting property, but affects hardness, anti-solubility, etc. as well, and therefore the hydrogenation rate is selected within a range which can maintain these characteristics well-balanced.

(D) Anti-damaging property of the blade material to the head

The blade bears against the discharge port forming surface at a certain speed and therefore may sometimes scrape off the discharge port forming surface itself or the water-repelling agent applied thereto. In order to prevent this as much as possible, it is preferable that the hardness of the blade material itself be not high and moreover not much inorganic additive be added.

(E) Liquid-contacting property to ink

The blade material which is in contact with ink may react to the ink to thereby degenerate the ink itself and also may cause scorching on an electro-thermal converting member which generates heat energy available to discharge the ink, by the influence of the components of the blade material dissolved into the ink.

Accordingly, it is necessary to add a small amount of plasticizer so that such influence may not occur. This will affect the molding of the product, but it is preferable to determine the amount of addition with the influence thereof upon the ink taken into account and improve the liquid-contacting property to ink.

(F) Cold-proof property (low temperature characteristic)

The blade material may be used in various environments, and it is not preferable that its characteristics be deteriorated particularly at low temperatures. The blade material can be improved so as to be excellent in low temperature characteristic by increasing the hydrogenation rate and therefore, it is preferable to select the hydrogenation rate with the balance thereof to the other characteristics taken into consideration.

As a blade material which sufficiently satisfies the characteristics as noted above and which could achieve a good cleaning effect, use was made of hydrogenated nitrile butadiene rubber of hardness 55° to make a blade as shown in FIGS. 4(A) and 4(B) which had a thickness of 0.5 mm, a length of contact of 20 mm with the recording head, a free length of 4 mm with respect to the direction of movement from the non-recording area to the recording area, indicated by arrow B in FIG. 4(B), and a free length of 8 mm with respect to the direction of movement from recording area to the non-recording area, indicated by arrow A in FIG. 4(B).

On the other hand, a blade of the same shape was made of silicone rubber of hardness 40°, and comparison was made between these two blades.

Figure 5:
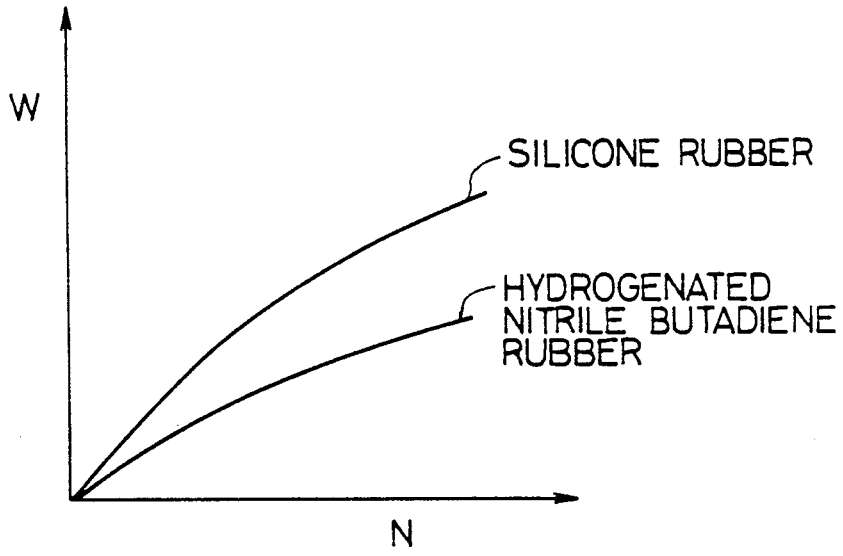
FIG. 5 is a graph showing the relations between the amount of recording and the amount of abrasion corresponding to silicone rubber and hydrogenated nitrile butadiene rubber, respectively.
Figure 6:
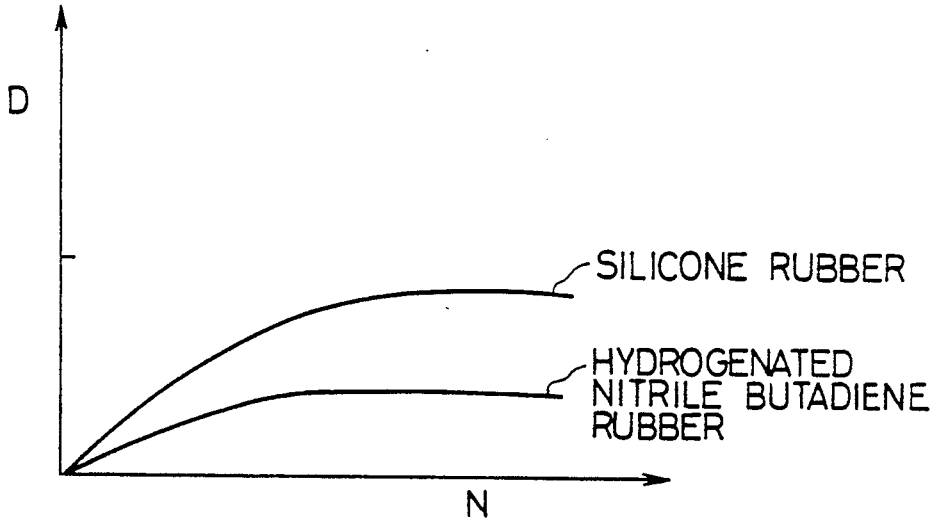
FIG. 6 is a graph showing the relations between the amount of recording and the wiping effect corresponding to silicone rubber and hydrogenated nitrile butadiene rubber, respectively.

The result of the comparison is shown in FIGS. 5 and 6.

FIG. 5 shows the relation between the number N of recorded sheets and the amount of abrasion W, and FIG. 6 shows the relation between the number of recorded sheets and the wiping effect (shown by the amount of adherence of ink, water content, rubber, etc.).

As is apparent from this result, it is seen that the blade made of hydrogenated nitrile butadiene rubber is excellent in wear resisting property and cleaning effect as compared with the blade made of silicone rubber.

As the shapes of the blade which are usable in the present embodiment, those which are described by the following numerical values, including those previously mentioned, are preferable.

(A) Hardness: As previously described, the hardness of hydrogenated nitrile butadiene rubber is preferably within the range of greater than 35° to less than 80°, and more preferably greater than 40° to less than 70°, and still more preferably greater than 45° to less than 65°.

(B) Thickness of the blade: The thickness of the blade is preferably within the range of greater than 0.2 mm to less than 1.5 mm, and preferably greater than 0.3 mm to less than 0.7 mm, and more preferably greater than 0.4 mm to less than 0.6 mm. Coupled with the hardness of the blade, the cleaning effect can be improved.

(C) Free length of the blade: 2 mm or greater will suffice, but from the viewpoint of the construction of the apparatus, a range up to the order of 15 mm can be adopted, and greater than 3 mm and less than 5 mm is more preferable. The apparent pressure of the discharge port forming surface of the head when the blade bears against the recording head is varied by the free length and therefore, the free length is selected with the balance thereof to the hardness, the thickness, etc. taken into account.

(D) The amount of entry of the blade (the amount of overlap of the blade with the head): As shown in FIG. 4C, the amount of contact (the amount of overlap $A_O$) of the blade with the recording head also greatly affects the cleaning effect, and if the amount of overlap $A_O$ is too great, there will not be obtained the effect of cleaning by the edge portion 301C of the blade and the cleaning effect will be reduced. In the cleaning by the blade, it is important in accomplishing effective cleaning to effect cleaning in such a state that the discharge port forming surface of the head is cleaned by the edge portion 301C of the blade. Also, if the amount of overlap is too small, the contacting force of the blade with respect to the recording head will be reduced, thus resulting in a reduced cleaning effect. Also, since the cleaning effect is affected by the hardness, the thickness, the free length, etc. of the blade, the amount of overlap should be determined with the balance thereof to these factors taken into account, and may be at least greater than 0.5 mm and less than 2.0 mm, and preferably greater than 0.8 mm and less than 1.5 mm.

As previously described, the cleaning effect can be improved by the balance among the material, the hardness, the thickness, the free length and the amount of overlap of the blade, but when determining the numerical values by the balance among these, it is important to select them suitably within a range in which the effect of cleaning the surface of the recording head by the edge portion 301C during the cleaning effected by the blade.

Figure 7:
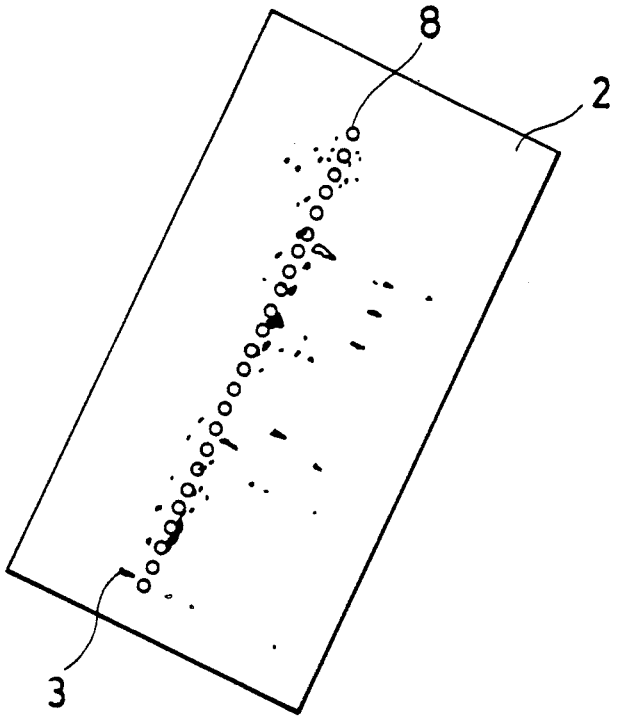
FIG. 7 is a schematic view showing an example of the discharge port forming surface when it is cleaned by the use of a blade according to the present invention.

When the discharge opening forming surface of the recording head was cleaned by the blade of the present invention which satisfies the characteristics as noted above, very effective cleaning could be accomplished as shown in FIG. 7.

By using as the blade material hydrogenated nitrile butadiene rubber which is a material high in ozone resistance, oil resistance and chemical resistance as well as in wear resistance, and forming the blade into a shape within the range of numerical values as mentioned above, there can be provided a cleaning member which is higher in cleaning effect than the heretofore used blades and which maintains durability for a long period of time.

There can also be provided an ink jet recording apparatus provided with a cleaning member which affects the discharge port forming surface of the recording head and ink very little and which is excellent in durability and displays the effect of improving the discharge characteristic for a long period of time.

The present invention brings about an excellent effect particularly in a recording head and a recording apparatus of the bubble jet type among the ink jet recording systems.

As regards the typical construction and principle of this system, it is preferable to practice by the use of the basic principle disclosed, for example, in U.S. Pat. No. 4,723,129 and U.S. Pat. No. 4,740,796. This system is applicable to both of the so-called on-demand type and the so-called continuous type, and particularly in the case of the on-demand type, it is effective because at least one driving signal corresponding to recording information and providing a rapid temperature rise exceeding nuclear boiling is applied to an electro-thermal converting member disposed correspondingly to a sheet or a liquid path on which liquid (ink) is retained, thereby generating heat energy in the electro-thermal converting member and causing film-boiling on the heat-acting surface of the recording head with a result that a bubble in the liquid (ink) can be formed in one-to-one correspondence to the driving signal. By the growth and contraction of this bubble, the liquid (ink) is discharged through a discharge opening to thereby form at least one droplet. If this driving signal is of a pulse-like shape, the growth and contraction of the bubble takes place appropriately on the spot and therefore, the discharge of the liquid (ink) particularly excellent in responsiveness can be achieved, and this is more preferable. What is described in U.S. Pat. No. 4,463,359 and U.S. Pat. No. 4,345,262 is suitable as this driving signal of a pulse-like shape. If the conditions described in U.S. Pat. No. 4,313,124 which discloses an invention relating to the temperature rise rate of the above-mentioned heat-acting surface are adopted, more excellent recording can be accomplished.

As regards the construction of the recording head, the present invention covers, besides the construction as disclosed in the above-mentioned patents wherein discharge ports, liquid paths and electro-thermal converting members are combined together (a rectilinear liquid flow path or a perpendicular liquid flow path), a construction using U.S. Pat. No. 4,558,333 and U.S. Pat. No. 4,459,600 which disclose a construction in which the heat-acting portion is disposed in a bent area. In addition, the present invention will also be effective if it adopts a construction based on Japanese Laid-Open Patent Application No. 59-123670 which discloses a construction in which a slit common to a plurality of electro-thermal converting members is used as the discharge portion of the electro-thermal converting member or Japanese Laid-Open Patent Application No. 59-138461 which discloses a construction in which an opening for absorbing the pressure wave of heat energy is made to correspond to the discharge portion.

Further, a recording head of the full line type which has a length corresponding to the width of the largest recording medium on which a recording apparatus can effect recording may adopt any of the constructions as disclosed in the above-mentioned specifications wherein that length is satisfied by a combination of a plurality of recording heads or a construction as a single recording head formed unitarily, and the present invention can display the above-described effect more effectively.

In addition, the present invention is also effective when use is made of a recording head of the interchangeable chip type which, by being mounted on an apparatus body, enables the electrical connection to the apparatus body and the supply of ink from the apparatus body thereto, or a recording head of the cartridge type in which a cartridge is integrally provided in the recording head itself.

Also, the addition of recovery means, preliminary auxiliary means, etc. to the recording head which are provided as the construction of the recording apparatus of the present invention as described above can more stabilize the effect of the present invention and is therefore preferable. Specifically mentioning these, the provision of capping means for the recording head, the cleaning means described herein, pressing or suction means, and an electro-thermal converting member or a heating element discrete therefrom or preheating means comprising a combination of these, and a preliminary discharge mode which carries out discharge discrete from recording is also effective for accomplishing stable recording.

Further, the recording mode of the recording apparatus is not limited to the recording mode of only the mainstream color such as black, but may be determined either by constructing the recording head unitarily or by combining a plurality of recording heads, and the present invention is also very effective for an apparatus provided with at least one of a composite color mode comprising different colors and full color mode using mixed colors.

What is claimed is:

1. A cleaning member for bearing against and thereby cleaning a discharge port forming surface of an ink jet recording head, wherein openings for discharging ink are formed through the discharge port forming surface, said cleaning member being formed of a material composed chiefly of hydrogenated nitrile butadiene rubber and the hardness of the hydrogenated nitrile butadiene rubber being at least 35° and no more than 80°.

2. A cleaning member according to claim 1, wherein the thickness of the hydrogenated nitrile butadiene rubber forming said cleaning member is at least 0.2 mm and less than 1.5 mm.

3. A cleaning member according to claim 1, wherein the free length of the hydrogenated nitrile butadiene rubber forming said cleaning member is greater than 2 mm.

4. A cleaning member according to claim 1, wherein the hydrogenated nitrile butadiene rubber forming said cleaning member is improved in hardness, chemical-resistance, heat-resistance, ozone-resistance and abrasion resistance by increasing the hydrogenation rate thereof.

5. An ink jet recording apparatus comprising:

an ink jet recording head provided with openings for discharging ink therethrough, said openings being provided through a discharge port forming surface;

carriage means for effecting the movement of said ink jet recording head along a movement path between a recording position in which recording is effected with said recording head opposed to a recording medium and a non-recording position in which said ink jet recording head is retracted from said recording position; and a cleaning member provided in the movement path between said recording position and said non-recording position for bearing against said discharge port forming surface of said ink jet recording head to thereby clean said discharge port forming surface, said cleaning member having an edge portion and being formed of a material composed chiefly of hydrogenated nitrile butadiene rubber, wherein the hardness of the hydrogenated nitrile butadiene rubber forming said cleaning member is at least 35° and no more than 80°, and cleaning is effected with said edge portion of said cleaning member moving relative to said discharge port forming surface while maintaining contact with said discharge port forming surface.

6. An ink jet recording apparatus according to claim 5, wherein the thickness of said cleaning member is at least 0.2 mm and no more than 1.5 mm.

7. An ink jet recording apparatus according to claim 5, wherein the free length of said cleaning member is at least 2 mm and no more than 15 mm.

8. An ink jet recording apparatus according to claim 5, wherein the amount of entry of said cleaning member beyond a plane defined by and parallel to said discharge port forming surface of said ink jet recording head is at least 0.5 mm and no more than 2 mm.

9. An ink jet recording apparatus according to claim 5, wherein said ink jet recording head utilizes heat energy to discharge ink, and is provided with an electrothermal converting member as means for generating the heat energy.

10. An ink jet recording apparatus according to claim 5, wherein the free length of said cleaning member varies depending on whether said ink jet recording head moves from said recording position to said non-recording position or from said non-recording position to said recording position.

11. An ink jet recording apparatus according to claim 5, wherein the free length of said cleaning member when said ink jet recording head moves from the recording area to the non-recording area is greater than the free length of said cleaning member when said ink jet recording head moves from the non-recording area to the recording area.

* * * * *

UNITED STATES PATENT AND TRADEMARK OFFICE

CERTIFICATE OF CORRECTION

PATENT NO. : 5,065,158 Page 1 of 2

DATED : November 12, 1991

INVENTOR(S) : TAKASHI NOJIMA, ET AL.

It is certified that error appears in the above-identified patent and that said Letters Patent is hereby corrected as shown below:

On the Title page, item [30] Foreign Application Priority Data:

Insert --[30] Foreign Application Priority Data
February 17, 1989 [JP] Japan....1-039157
February 15, 1990 [JP] Japan....2-032445--

On the Title page, item [56] FOREIGN PATENT DOCUMENTS:

"57-61574 4/1982" should read --57-61574 4/1982 Japan--.

On the Title page, item [57] ABSTRACT:

Line 5, "surface is" should read --surface. The cleaning member is--.

COLUMN 1:

Line 25, "causes" should read --cause--.

COLUMN 2:

Line 45, "3,298,038" should read --3,298,030--.

UNITED STATES PATENT AND TRADEMARK OFFICE

CERTIFICATE OF CORRECTION

PATENT NO. : 5,065,158 Page 2 of 2

DATED : November 12, 1991

INVENTOR(S) : TAKASHI NOJIMA, ET AL.

It is certified that error appears in the above-identified patent and that said Letters Patent is hereby corrected as shown below:

COLUMN 7:

Line 63, "chemcial-resisting" should read --chemical-resisting--.

COLUMN 8:

Line 16, "reduced unsaturated" should read --reduced in unsaturated--; and

Line 17, "in" should be deleted.

Signed and Sealed this

Fifteenth Day of June, 1993

Attest:

Michael K. Kirk

MICHAEL K. KIRK

Attesting Officer

Acting Commissioner of Patents and Trademarks